US005813747A

United States Patent [19]

Kale

[11] Patent Number: 5,813,747

[45] Date of Patent: Sep. 29, 1998

[54] CHRISTMAS TREE LIGHTS

[76] Inventor: B. J. Kale, 1625 Rosewell Rd., #432, Marietta, Ga. 30062

[21] Appl. No.: 866,746

[22] Filed: May 30, 1997

[51] Int. Cl.[6] ..... F21P 1/02

[52] U.S. Cl. ..... 362/123; 362/252; 362/391; 362/353; 362/806; 362/812

[58] Field of Search ..... 40/551, 552; 362/255, 362/252, 353, 363, 806, 808, 812, 391, 123

[56] References Cited

U.S. PATENT DOCUMENTS

| | | | |
|---|---|---|---|
| D. 298,738 | 11/1988 | Rumpel | D8/395 |
| D. 331,360 | 12/1992 | Adams | D8/373 |
| D. 340,846 | 11/1993 | Nichols, Jr. | D8/14 |
| D. 345,430 | 3/1994 | Ridgeway | D26/25 |
| D. 351,915 | 10/1994 | Hermanson | D26/25 |
| 2,714,652 | 8/1955 | Meyer | 362/806 |
| 2,749,432 | 6/1956 | Dorsey | 362/255 |
| 4,234,915 | 11/1980 | Malinowski et al. | 362/252 |
| 5,024,406 | 6/1991 | Ketcham | 248/149 |
| 5,245,519 | 9/1993 | Openiano | 362/252 |
| 5,388,802 | 2/1995 | Dougan et al. | 248/74.2 |
| 5,526,931 | 6/1996 | White | 206/420 |
| 5,542,636 | 8/1996 | Mann et al. | 248/229.26 |

*Primary Examiner*—Stephen F. Husar

[57] ABSTRACT

Christmas tree lights (10) are displayed on a tree (14). The Christmas tree lights (10) comprise a wire (12) connected to a power means. The Christmas tree lights (10) further comprise a plurality of wire lights (12A) electrically spliced within the wire (12). The Christmas tree lights (10) further comprise a light housing which comprises an opening therein within which a wire light (12A) is removably inserted. The housing is selected from a group consisting of letter, number, ornament, statue, and figurine. The light housing may optionally have a wire grip within which the wire (12) securely engages. The wire grip functions to hold the wire light (12A) within the light opening.

8 Claims, 5 Drawing Sheets

CHRISTMAS TREE LIGHTS

BACKGROUND OF THE INVENTION

1. Field of the Invention

The present invention relates to lighted holiday decoration. More particularly, the present invention relates to lighted ornaments for a Christmas tree.

2. Description of the Prior Art

The use of lighted devices on holiday decorations is well known in the prior art. More particularly lighted devices which attach to a Christmas Tree in the form of a string are well known. Various types of lighted string can be found which include a series of light bulbs in various voltages strung together. When lighted the effect is of many small points of light.

Numerous innovations for Christmas tree lights have been provided in the prior art that are described as follows. Even though these innovations may be suitable for the specific individual purposes to which they address, they differ from the present invention as hereinafter contrasted.

In U.S. Pat. No. 5,542,636, dated Aug. 06, 1996, titled Clips for Supporting Miniature Christmas Lights at Any of a Plurality of Locations, invented by John P. Mann, Files on Nov. 23, 1994, a clip for supporting miniature Christmas lights at any of a plurality of locations comprising an one-piece clip fabricated of a plastic material with limited resilience. Alight supporting component is formed in a generally C-shaped configuration about a vertical axis of rotation. The supporting component is greater than 180 degrees and less than 190 degrees. A second component is formed integrally with the first component. The second component is adapted to be secured to a recipient surface to maintain the first component and the supportive bulb in a vertical orientation.

In U.S. Pat. No. 5,245,519, issued Sep. 14, 1993, titled Multi-Branched Christmas Lights, invented by Renato M. Openiano, filed on Feb. 18, 1992, an ornamental Christmas light decorating system containing one or more clusters of flashing lights, which can be shaped by an user and attached to a various surfaces. The cluster provide a perception of directional movement or chasing of light.

In U.S. Pat. No. 5,526,931, issued Jun. 18, 1996, titled Carrier for Long, Flexible Elements Such as Christmas Lights, invented by Dallas White, filed on Oct. 12, 1994, a carrier includes a base and handle on each end of that base with the handles being coaxial with the central axis of the base so that long, flexible elements, such as Christmas lights, that are to be stored on the carrier can be easily wound on to the carrier as well as unwound from that carrier. A plurality of arms are included and cavities are located near the central axis for releasably accommodating electrical plugs associated with the flexible elements. One embodiment of the carrier has handles fixed to a base, and a second embodiment has a swivel connection between the base and the handles. Hook receivable holes are defined in the handles on the central axis whereby the carrier can be pendently supported for storage.

In U.S. Pat. No. 5,388,802, titled Method and apparatus for suspending Christmas lights underneath eaves on a house, filed Jan. 13, 1994 invented by William B. Dougal & Murry Nesbitt, issued on Feb. 14, 1995, a method of suspending Christmas lights underneath eaves of a house finished with aluminum or vinyl soffit panels and fascia. Firstly, attach a plurality of wedge shaped members to a string of Christmas lights. Secondly, insert the wedge shaped members between the fascia and soffit of the house. The Christmas lights protrude perpendicularly below the fascia and are clearly visible from adjacent street while the wedge shaped members are hidden from view by the fascia.

In U.S. Pat. No. 5,024,406, filed Jan. 31, 1990, titled Device for Hanging Outdoor Christmas Lighting, filed Jun. 18, 1991, invented by Raymond H. Ketcham, a hanging outdoor Christmas light holder for a lamp socket fixture is provided and consists of a removably attaching member having as first component that is permanently attachable to a static structure on a building, while a second mating component is carried on underside of the lamp socket fixture so that the lamp socket fixture can be quickly and simply attached thereto and removed therefrom.

In U.S. Pat. No. Des. 298,738, titled Clip for Christmas Lights, invented by Donald D. Rumpel, filed on May 15, 1986, issued on Nov. 29, 1988, an ornamental design for a clip for Christmas lights is shown and described.

In U.S. Pat. No. Des. 351,915, titled Set of Transparent Christmas Lights, invented by Terry Hermanson, filed on Feb. 7, 1992, issued on Oct. 25, 1994, an ornamental design for a clip for a set of transparent Christmas lights is shown and described.

In U.S. Pat. No. Des. 331,360, titled Hook for Supporting Christmas Lights Adjacent Roofing Shingles, invented by William E. Adams, filed May 08, 1991, issued Dec. 1, 1992, an ornamental design for a hook for supporting Christmas lights adjacent roofing shingles is shown and described.

In U.S. Pat. No. Des. 361,032, titled Clip for Hanging Christmas Lights, invented by William B. Dougan, filed Jun. 11, 1993, issued Aug. 08, 1995, an ornamental design for a clip for hanging Christmas lights is shown and described.

In U.S. Pat. No. Des. 340,846, titled Implement Head for Relocating Christmas Lights, invented by David J. Nichols, Jr., filed Jun. 18, 1991, issued Nov. 2, 1993, an ornamental design for an implement head for relocating Christmas lights is shown and described.

In U.S. Pat. No. Des. 345,430, titled Set of Battery Powered Miniature Christmas Lights, invented by Jerry D. Ridgeway, filed Sep. 23, 1991, issued Mar. 22, 1994, an ornamental design for a set of battery powered miniature Christmas lights is shown and described.

The above patented inventions differ from the present invention because they fail to describe or claim at least one combination of the following features depicted in the present invention a hollow letter or shape which is adapted to receive a Christmas light. The Christmas lights function to illuminate the letter or shape when the Christmas light is illuminated. A fastening means removably secures the hollow shape or letter to the Christmas wire. The hollow letter or shape is formed into resemblances of characters of the holiday period Numerous innovations for Christmas tree lights have been provided in the prior art that are adapted to be used. Even though these innovations may be suitable for the specific individual purposes to which they address, they would not be suitable for the purposes of the present invention as heretofore described.

SUMMARY OF THE INVENTION

Holiday lighting consisting of multiple light bulbs spaced apart in a string configuration can be enhance by inserting the bulbs in a hollow shape having optical properties which cause it to become illuminated from the light of the bulb. The hollow shape can be formed into various forms including letters, characters.

The types of problems encountered in the prior art are enhancement of holiday decoration with illumination.

In the prior art, unsuccessful attempts to solve this problem were attempted namely light bulbs on an electrical wire string and devices to fasten the light bulbs on a string of electrical wires to a structure including trees which lack. However, the problem was solved by the present invention because a light bulb is inserted into the present invention and fastened with a fastening means.

The present invention solved a long felt need for a new and innovative enhancement of holiday decorations.

Accordingly, it is an object of the present invention to provide a wire having a plurality of wire lights spaced apart.

More particularly, it is an object of the present invention to provide a shape, which is attached around a light bulb of a string of Christmas lights and is translucent or transparent being illuminated from the inside by each light.

In keeping with these objects, and with others which will become apparent hereinafter, one feature of the present invention resides, briefly stated, in a hollow interior through which light is propagated from the light bulb to the interior surface whereat the light enters the medium of the present invention and transverses the medium being emitted at the exterior surface.

When the Christmas tree lights are designed in accordance with the present invention, a first word first letter having a first word first letter light opening is attached around a bulb on a string of holiday lights.

Another feature of the present invention is that a stocking wire grip is adapted to releasably attach to the wires on opposite sides of a Christmas light on a Christmas light string.

In accordance with another feature of the present invention, a plurality of first word first letter having a first word first letter light openings may be attached and the shapes preselected to form words or messages which are illuminated.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—Christmas tree lights (10)

12—wire (12)

12A—wire light (12A)

12BA—first word first letter (12BA)

12BAA—first word first letter light opening (not shown)

12BB—first word second letter (12BB)

12BBA—first word second letter light opening (not shown)

12BC—first word third letter (12BC)

12BCA—first word third letter light opening (not shown)

12BD—first word forth letter (12BD)

12BDA—first word forth letter light opening (not shown)

12CA—second word first letter (12CA)

12CAA—second word first letter light opening (not shown)

12CB—second word second letter (12CB)

12CBA—second word second letter light opening (not shown)

12D—stocking (12D)

12DA—stocking light opening (12DA)

12DB—stocking wire grip (12DB)

14—tree (14)

DESCRIPTION OF THE PREFERRED EMBODIMENT

Figure 1:
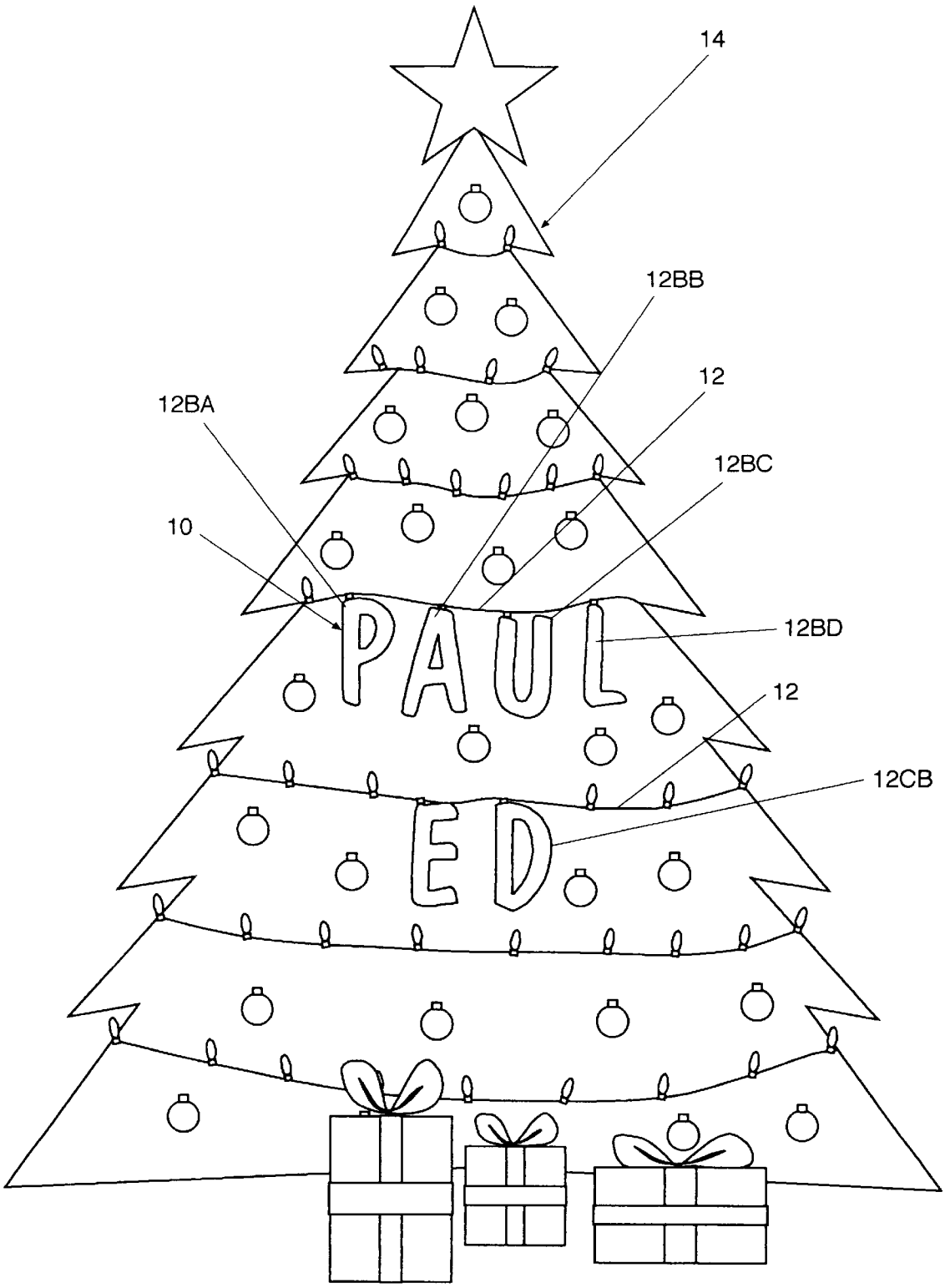
FIG. 1 is a side view of a tree displaying Christmas tree lights thereon.

Firstly, referring to FIG. 1 which is a side view of a tree (14) displaying Christmas tree lights (10) thereon. The Christmas tree lights (10) comprise a wire (12) connected to a power means. The Christmas tree lights (10) further comprise a plurality of wire lights (12A) electrically spliced within the wire (12). The Christmas tree lights (10) further comprise a light housing which comprises an opening therein within which a wire light (12A) is removably inserted.

Figure 2:
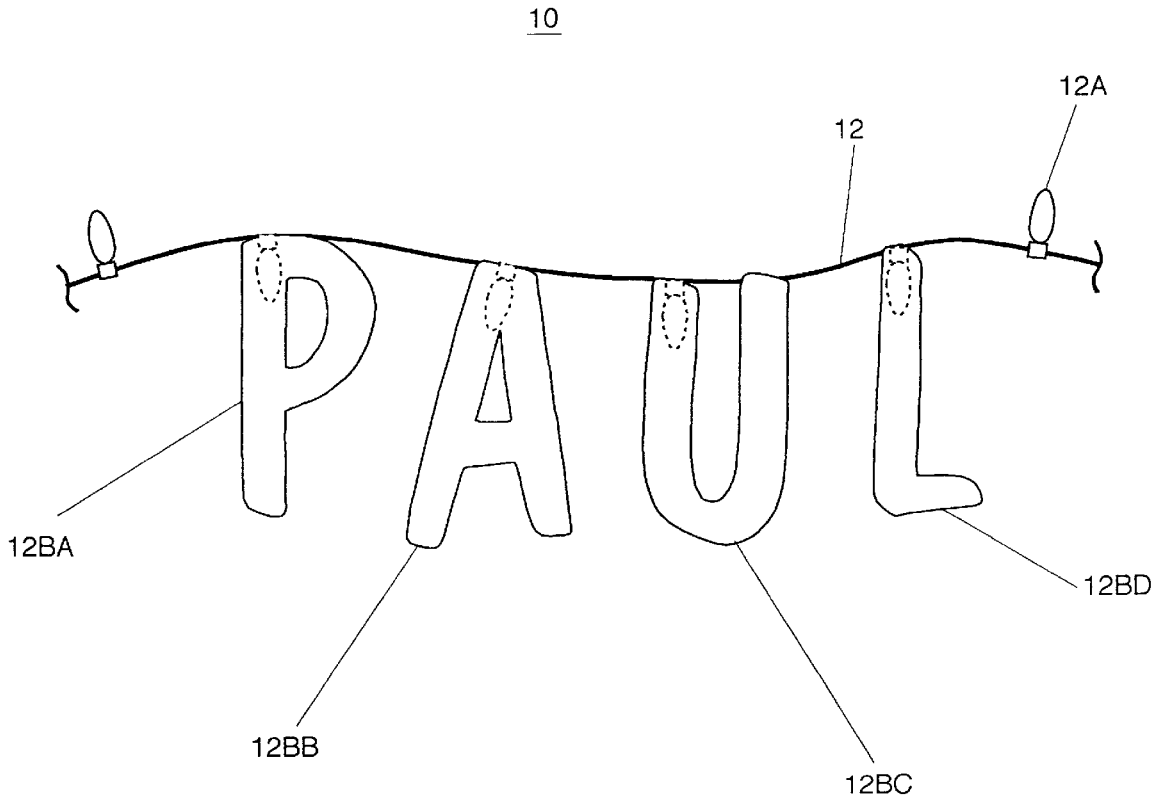
FIG. 2 is a side view of Christmas tree lights.

Referring to FIG. 2 which is a side view of Christmas tree lights (10). The light housing is preferably manufactured from a transparent or translucent material. The material is selected from a group consisting of plastic, plastic composites, glass, crystal, rubber, rubber composite, fiberglass, epoxy, and carbon-graphite. The light housing is a letter. The letter is a plurality of letters consisting of first word first letter (12BA) having a first word first letter light opening (not shown), first word second letter (12BB) having a first word second letter light opening (not shown), first word third letter (12BC) having a first word third letter light opening (not shown), and first word forth letter (12BD) having a first word forth letter light opening (not shown). An individual wire light (12A) is inserted into each of the first word first letter light opening (not shown), the first word second letter light opening (not shown), the first word forth letter light opening (not shown), and the first word second letter light opening (not shown). The plurality of letters form a first word.

The letter is a plurality of letters consisting of second word first letter (12CA) having a second word first letter light opening (not shown) and a second word second letter (12CB) having a second word second letter light opening (not shown). An individual wire light (12A) is inserted into each of the first word first letter light opening (not shown), the second word first letter light opening (not shown) and the second word second letter light opening (not shown). The plurality of letters forms a second word. The plurality of letters may optionally form a phrase. The light housing may optionally have a wire grip within which the wire (12) securely engages. The wire grip functions to hold the wire light (12A) within the light opening attaching the letter, stocking (12D) or other ornament to the wire (12). The housing is selected from a group consisting of letter, number, ornament, statue, and figurine.

Figure 3:
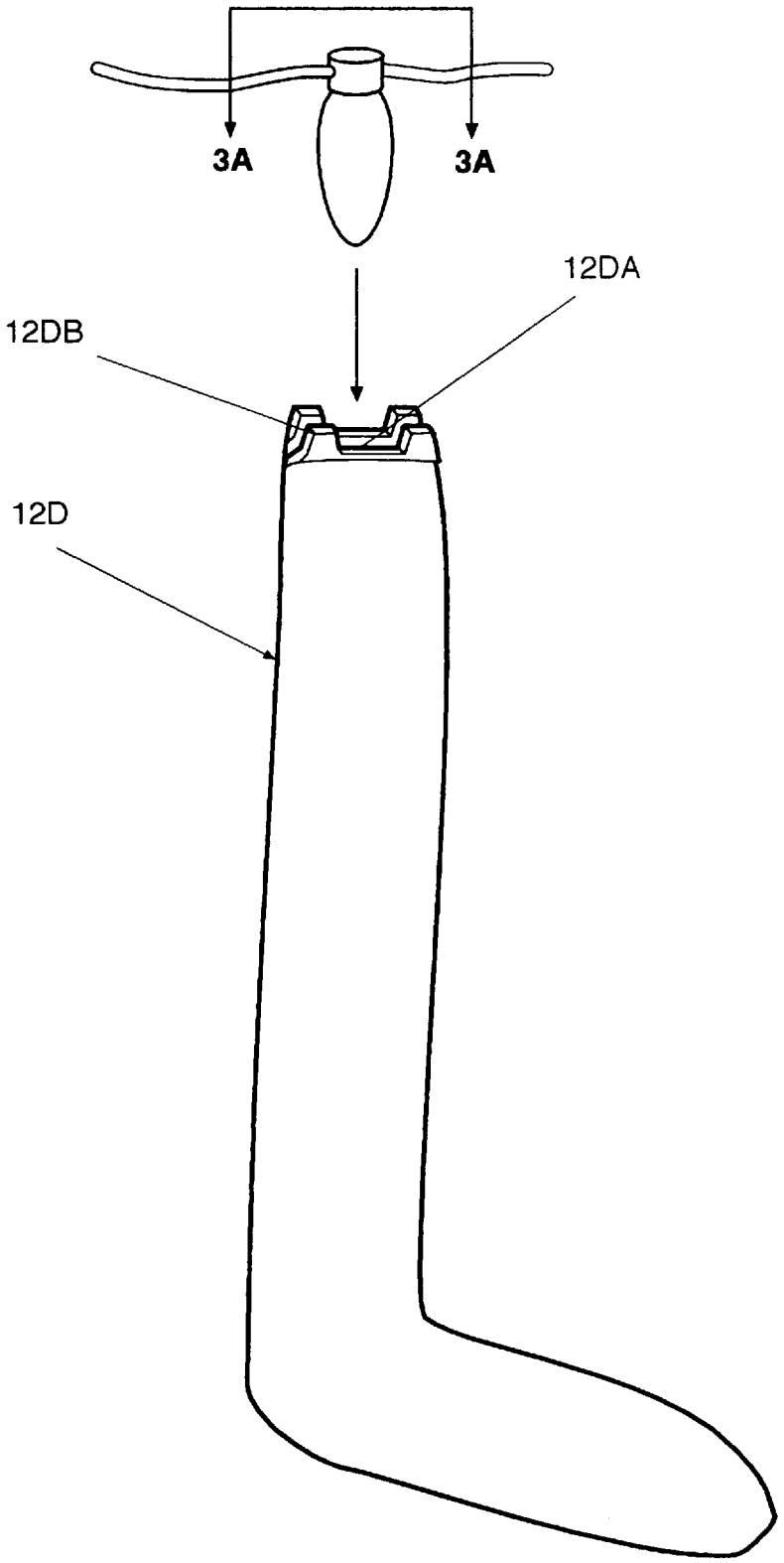
FIG. 3 is a side view of a wire light inserting into a stocking.

Now, referring to FIG. 3 which is a side view of a wire light (12A) inserting into a stocking (12D). The light housing is a stocking (12D). The stocking (12D) comprises a stocking light opening (12DA) within which a wire light (12A).

Figure 3A:
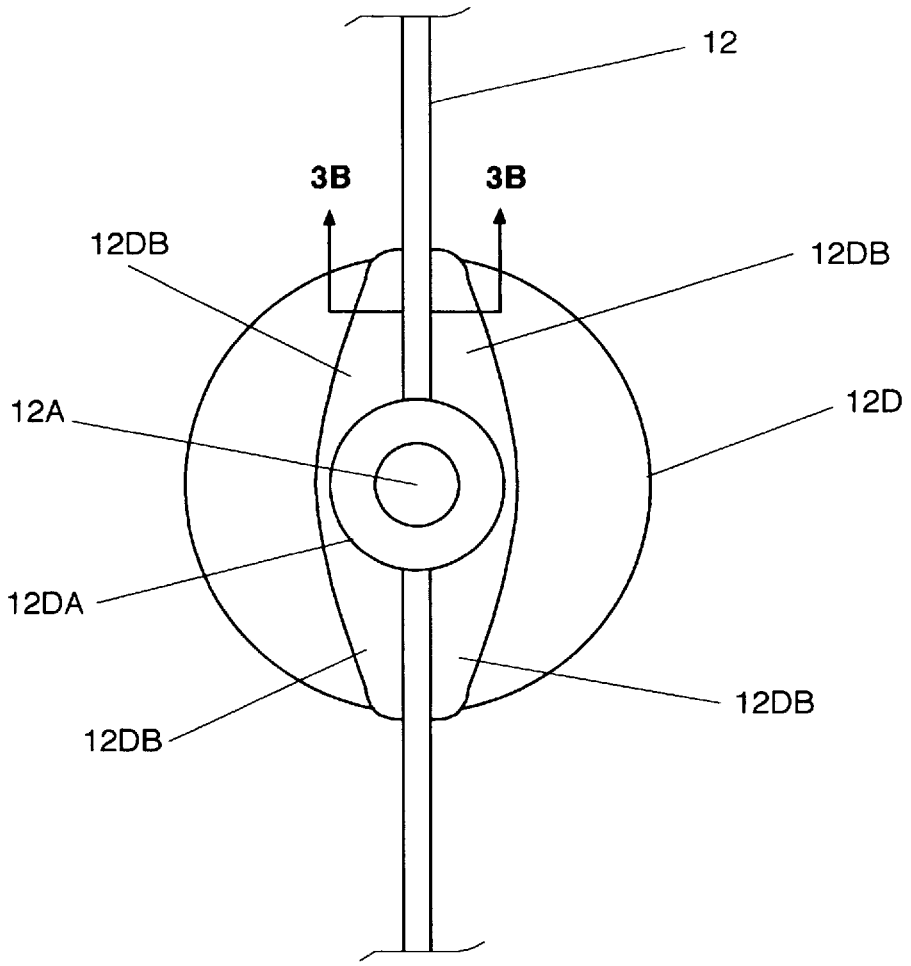
FIG. 3A is a top view of a stocking along line 3A—3A of FIG. 3.
Figure 3B:
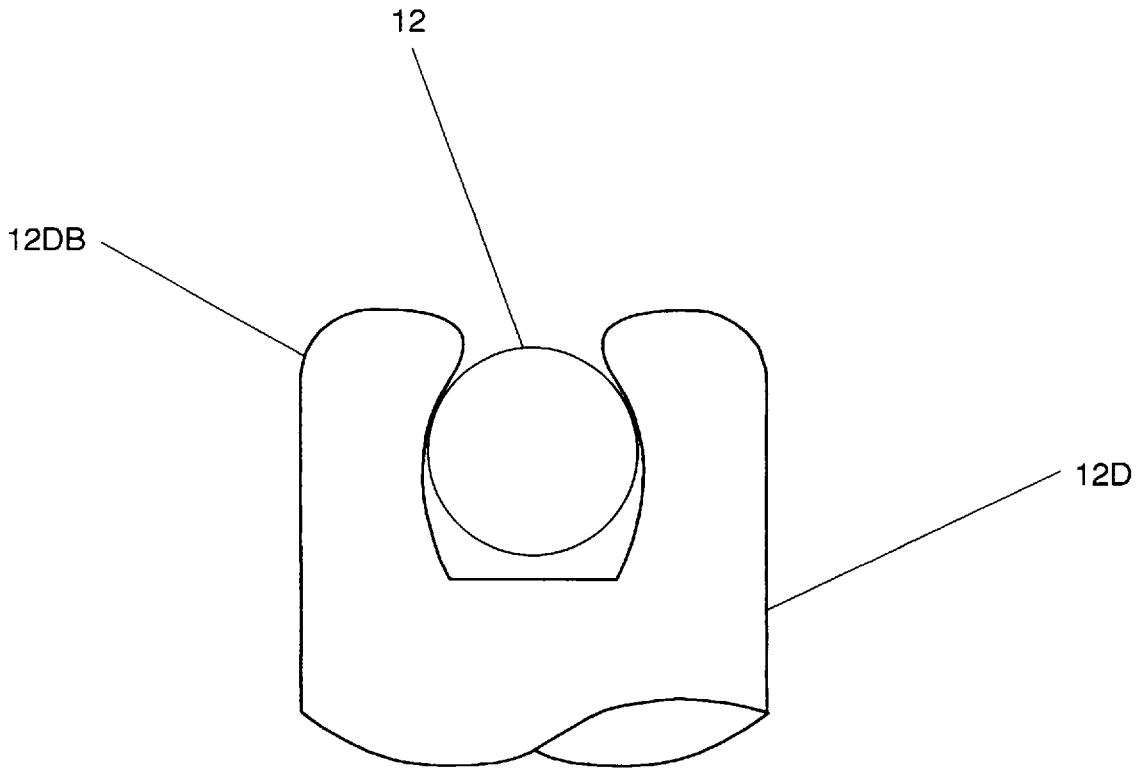
FIG. 3B is a cross sectional view of a stocking along line 3B—3B of FIG. 3A.

Lastly, referring to FIG. 3A is a top view of a stocking (12D) along line 3A—3A of FIG. 3. The stocking (12D) further comprises a stocking wire grip (12DB). FIG. 3B is a cross sectional view of a stocking (12D) along line 3B—3B of FIG. 3A. The wire grip functions to hold the wire light (12A) within the light opening attaching the stocking (12D) or other ornament to the wire (12).

It will be understood that each of the elements described above, or two or more together, may also find an useful application in other types of constructions differing from the type described above.

While the invention has been illustrated and described as embodied in a Christmas tree lights, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A decorative light set (10) comprising:

A) a wire (12) connected to a power means;

B) a plurality of wire lights (12A) electrically spliced within the wire (12); and C) at least one light housing which comprises an opening therein within which one of said wire lights (12A) is removably inserted, and wherein the light housing is a letter and is manufactured from a transparent or translucent material.

2. The decorative light set (10) as described in claim 1, wherein the material is selected from a group consisting of plastic, plastic composites, glass, crystal, rubber, rubber composite, fiberglass, epoxy, and carbon-graphite.

3. The decorative light set (10) as described in claim 1, wherein the letter comprises a first plurality of letters consisting of first word first letter (12BA) having a first word first letter light opening, first word second letter (12BB) having a first word second letter light opening, first word third letter (12BC) having a first letter third word light opening, and first word fourth letter (12BD) having a first word fourth letter light opening, said individual wire lights (12A) are inserted into each of the first word first letter light opening, the first word second letter light opening, the first word third letter light opening, and the first word fourth letter light opening.

4. The decorative light set (10) as described in claim 3, wherein the plurality of letters form a first word.

5. The decorative light set (10) as described in claim 3, wherein the letter further comprises a second plurality of letters consisting of a second word first letter (12CA) having a second word first letter light opening a second word second letter (12CB) having a second word second letter light opening, and said individual wire lights (12A) are inserted into each of the the second word first letter light opening and the second word second letter light opening.

6. The decorative light set (10) as described in claim 5 wherein the plurality of letters forms a second word.

7. The decorative light set (10) as described in claim 6 wherein the first and second words form a phrase.

8. The decorative light set (10) as described in claim 1, wherein the light housing has a wire grip within which the wire (12) securely engages.

* * * * *

UNITED STATES PATENT AND TRADEMARK OFFICE

CERTIFICATE OF CORRECTION

PATENT NO. : 5,813,747

DATED : September 29, 1998

INVENTOR(S) : B. J. Kale

It is certified that error appears in the above-identified patent and that said Letters Patent is hereby corrected as shown below:

Title page, item [76], inventor's address should read – B. J. Kale, 1918 Cheatham Woods Drive, Marietta, GA 30060 instead of B. J. Kale, 1625 Rosewell Rd., #423, Marietta, GA. 30062.--.

Signed and Sealed this

Seventeenth Day of November, 1998

*Attest:*

Bruce Lehman

BRUCE LEHMAN

*Attesting Officer*

*Commissioner of Patents and Trademarks*